United States Patent [19]

Fortune et al.

[11] Patent Number: 4,950,196

[45] Date of Patent: Aug. 21, 1990

[54] HAND BASKET WITH ATTACHED TOY

[75] Inventors: Frederick A. Fortune; Timothy Bumb, both of San Jose, Calif.

[73] Assignee: Fact Games, Ltd., San Jose, Calif.

[21] Appl. No.: 424,544

[22] Filed: Oct. 20, 1989

[51] Int. Cl.[5] ..... A63H 33/00; B65D 13/00

[52] U.S. Cl. ..... 446/73; 446/327; 206/457; 217/122

[58] Field of Search ..... 446/72–74, 446/77, 78, 75, 76, 268, 369, 901, 327; 206/457, 216; 217/122; D11/144; 47/41.01, 66

[56] References Cited

U.S. PATENT DOCUMENTS

| | | | |
|---|---|---|---|
| 2,175,319 | 10/1939 | Rubenstein | 446/74 X |
| 2,594,896 | 4/1952 | Feldman | 446/73 X |
| 3,520,078 | 7/1970 | Klamer | 446/73 |
| 3,791,550 | 2/1974 | Duncan | 206/457 X |
| 4,101,032 | 7/1978 | Obidniak | 428/7 X |

*Primary Examiner*—Mickey Yu

*Attorney, Agent, or Firm*—Phillips, Moore, Lempio & Finley

[57] ABSTRACT

A hand basket has a toy, such as a stuffed animal or the like, releasably attached exteriorly thereon. In one embodiment of this invention, the toy is formed integrally and has member parts thereof releasably attached on the basket. In a second described embodiment, feet of the toy are separate from the toy's main body portion and can be detached from the basket to constitute slippers. Further, the main body portion of the toy can be detached to constitute a puppet.

9 Claims, 2 Drawing Sheets

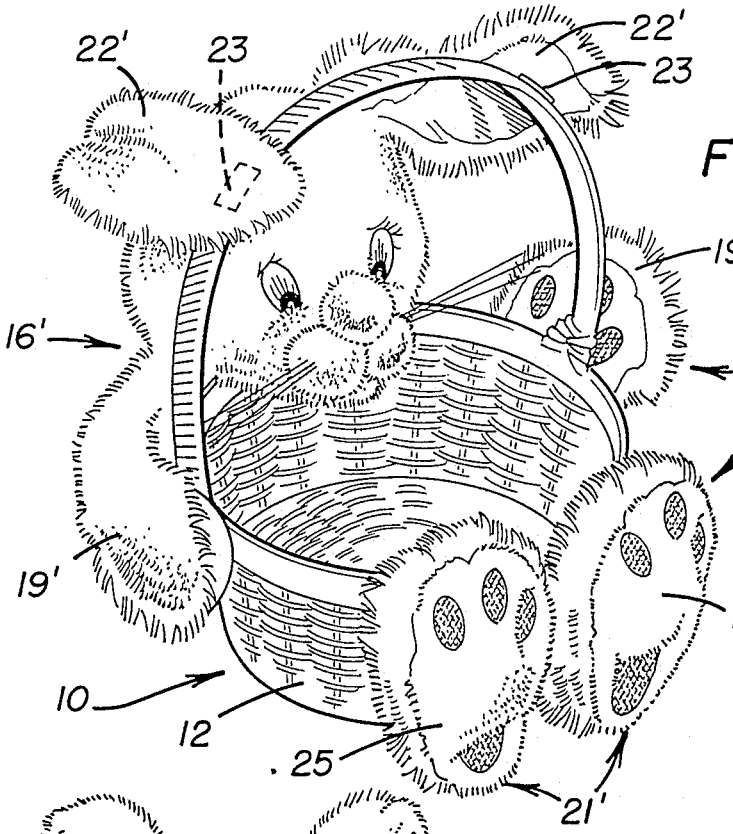
FIGURE 3
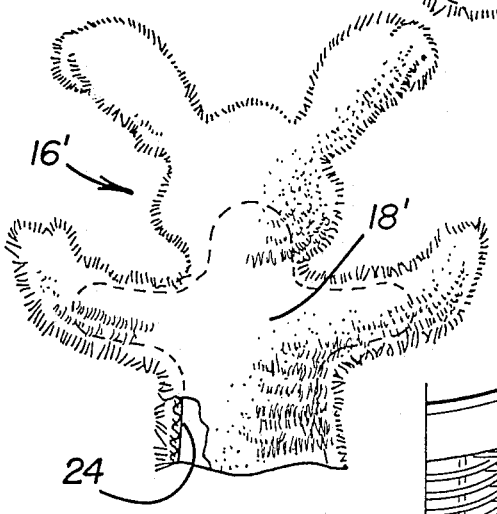
FIGURE 4
FIGURE 5
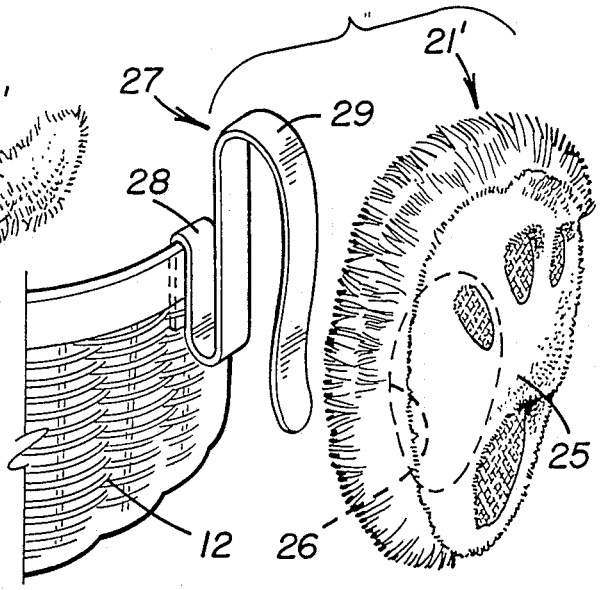

HAND BASKET WITH ATTACHED TOY

TECHNICAL FIELD

This invention relates generally to a decorative receptacle and more particularly to a hand-basket having a toy releasably attached thereon.

BACKGROUND OF THE INVENTION

Decorative hand baskets are oftentimes used for festive occasions, such as Easter, Halloween and Christmas, to accommodate various gifts and foodstuffs. The baskets are commonly decorated with ribbons and other decorative embellishments. On many such occasions, it is desirable to include a stuffed toy or the like with the basket for gift-giving purposes. Placing of the toy in the basket greatly reduces the available space for other items. Further, fragile items contained in the basket are subjected to damage when the basket is inadvertently dropped and/or an exterior force is imposed on a sidewall of the basket.

SUMMARY OF THE INVENTION

An object of this invention is to provide a basket-toy combination adapted to provide the dual function of a receptacle and a detachable toy.

The basket has a bottom and an upstanding sidewall defining a receptacle therein. Fastening means are provided for attaching the toy exteriorly on the basket. In one described embodiment of this invention, the toy is formed integrally and has its member parts releasably attached on the sidewall of the basket. In a second described embodiment, the toy comprises a body portion attached on one side of the basket and a pair of separate feet attached on an opposite side of the basket. The feet can be removed from the basket to function as slippers whereas the body portion can be removed to function as a puppet.

BRIEF DESCRIPTION OF THE DRAWINGS

Other objects and advantages of this invention will become apparent from the following description and accompanying drawings wherein:

FIG. 3 is a view similar to FIG. 1, but illustrates a second basket-toy embodiment of this invention;

FIG. 4 is a backside elevational view of a body portion of the FIG. 3 toy, adapted to be removed from the basket and used as a puppet; and FIG. 5 is an enlarged exploded view illustrating means for attaching and removing a foot of the toy from the basket for use as a slipper.

DESCRIPTION OF THE PREFERRED EMBODIMENTS

Figure 1:
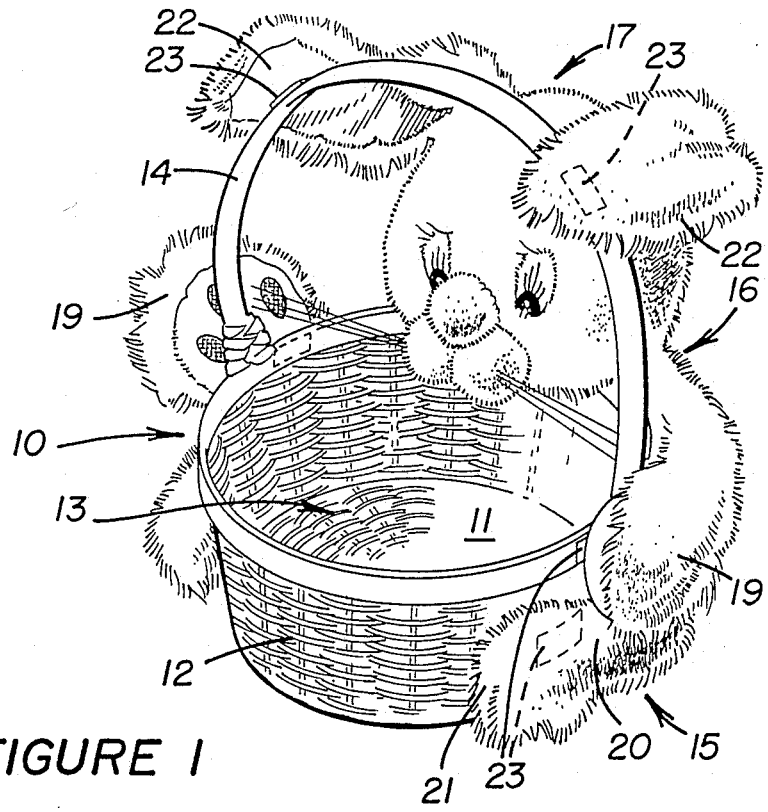
FIG. 1 is a frontal isometric view illustrating a hand-basket with an attached toy.
Figure 2:
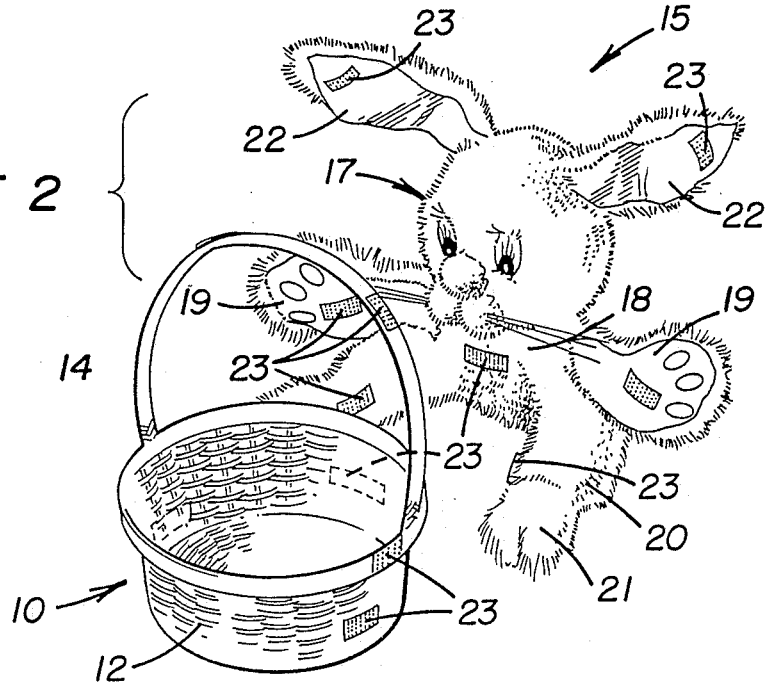
FIG. 2 is an exploded isometric view of the basket and toy showing them in unattached relationship.

FIGS. 1 and 2 illustrate a hand-basket 10 having a bottom 11 and an upstanding sidewall 12 defining a receptacle 13 in the basket, adapted to retain various items, such as non-perishable gifts and foodstuffs. An arcuate handle 14 is secured to opposite sides of sidewall 12 to extend above and over receptacle 13. The basket can be constructed of any suitable and standard synthetic or natural material and may be solid in construction or woven in the manner illustrated. Further, the bottom and sidewall can be configured to provide oval, rectangular or other polygonal shapes, other than the circular configuration illustrated.

A toy 15 is disposed exteriorly on the basket and may be formed as a bunny rabbit of the type illustrated, or may constitute other types of stuffed animals, such as a reindeer, bear, cat, duck or frog. Further, other types of stuffed toys, such as a pumpkin, ghost, Santa Claus or clown, could be used in lieu of the illustrated bunny rabbit. The consumer is enabled to replace the detachable bunny rabbit, a typical Easter toy, with a stuffed toy having significance for a particular festive holiday.

The toy is preferably composed of a plush-pile material, such as wool, cotton, nylon, acrylic, etc., forming a covering suitably filled with a standard stuffing material, such as cotton. Toy 15, shown in the form of a bunny rabbit, comprises a body portion 16 having a head 7, a torso 18 and a pair of arms 19. In addition, the toy includes legs 20 terminating at feet 21. In the illustrated bunny rabbit toy embodiment of this invention, a pair of floppy ears 2 are secured on head 17.

Fastening means for releasably attaching the toy exteriorly on the basket preferably comprises a plurality of conventional Velcro brand hook and loop fasteners 23. As shown in FIGS. 1 and 2, first parts of fasteners 23 are suitable secured (by adhesive or stitching) in strip-form to the frontal side of torso 18, the undersides of arms 19, the innersides of legs 20 or feet 21, and the innersides of ears 22. Similar strips of second parts of the fasteners are suitably secured to strategic locations on hand-basket 10, as shown in FIG. 2, to firmly attach the toy thereon. The fasteners can, of course, be applied at additional locations and other type of fasteners, such as snap fasteners, could be utilized in lieu of the preferred Velcro branch hook and loop type of fastener.

It should be noted in FIG. 1 that when toy bunny rabbit 15 is attached on hand-basket 10, that head 17 of the bunny rabbit will face through the opening defined within handle 14 of the hand-basket. In addition to providing an aesthetically pleasing appearance, this arrangement of the plush-pile toy exteriorly on the basket will help to protect the contents of the basket. In particular, the stuffed toy provides cushioning means for the basket's contents should the basket be dropped and/or should an external force be imposed thereon. As suggested above, the consumer's ability to readily detach the toy from the basket adapts the basket for use with other types of toys, suitable for many festive occasions.

FIGS. 3–5 illustrate the use of hand-basket 10 with a toy 15' having a body portion 16' separated from its pair of feet 21'. Common numerals appearing in FIGS. 3–5 depict constructions corresponding to like-numbered constructions shown in FIGS. 1 and 2.

Velcro brand hook and loop fasteners 23 are preferably used to releasably attach a torso 18', arms 19', and ears 22' of body portion 16' to basket 10 in the manner described above. With the body portion of the toy attached to a first side of the basket and with feet 21' attached on an opposite, second side of the basket in the manner shown in FIG. 3, the toy bunny rabbit simulates a sitting position in the basket. As shown in FIG. 4, when body portion 16', is removed from the basket, it will constitute a puppet having a closed hand-receiving receptable 24 defined therein.

Referring to FIG. 5, feet or paws 21' of the toy can be likewise removed from the basket to constitute slippers. In particular, each foot or slipper 21' has a sole 25 and is otherwise suitably constructed to form a foot-receiving receptacle 26 therein, whereby the slipper can be slipped onto a child's foot in a conventional manner. A mounting bracket 27 may be used to removably attach feet or slippers 21' on the basket. The bracket comprises an inverted U-shaped clip 28 slip-fitted over the upper edge of sidewall 12 of the basket. A slipper support 29 is generally configured in a length-wise direction to foot-receiving receptacle 26, defined in each slipper.

Other types of mounting or fastening means can be utilized to releasably attach the feet or slippers on basket 10. For example, strategically located Velcro brand hook and loop fasteners of the type described above could be utilized for this purpose.

We claim:

1. The combination comprising, a basket having a bottom and an upstanding sidewall defining a receptacle, a three dimensional toy disposed exteriorly on said basket, said toy comprising a body portion having a head, a torso, a pair of arms and a pair of feet, and fastening means for attaching said toy exteriorly on said basket, said fastening means releasably attaching said torso and said pair of feet exteriorly on the sidewall of said basket.

2. The combination of claim 1 wherein said toy is stuffed and covered with a plush-pile material.

3. The combination of claim 1 wherein said fastening means also releasably attaches said arms exteriorly on said basket.

4. The combination of claim 1 wherein said basket further comprises a handle secured to opposite sides of said sidewall to extend above and over said receptacle and wherein the head of said body portion faces an opening defined through said handle.

5. The combination of claim 4 further comprising ears secured on said head and further comprising additional fastening means for releasably attaching said ears to said handle.

6. The combination of claim 1 wherein said body portion and said pair of feet are separated from each other and wherein said fastening means releasable attaches said body portion to said sidewall on a first side of said basket and releasably attaches said pair of feet to said sidewall on an opposite, second side of said basket to simulate said toy sitting in said basket.

7. The combination of claim 6 wherein said pair of feet each constitutes a slipper, having a sole and a foot-receiving receptacle defined therein.

8. The combination of claim 6 or 7 wherein the torso of said body portion constitutes a puppet, having a hand-receiving receptacle defined therein.

9. The combination comprising a basket having a bottom, an upstanding sidewall defining a receptacle, and a handle secured to opposite sides of said sidewall to extend above and over said receptacle to define an opening therethrough, a toy disposed exteriorly on said basket comprising a body portion having a head facing said opening, ears secured on said head, a torso, a pair of arms and a pair of feet, and fastening means releasably attaching said torso and said pair of feet exteriorly on said basket and further releasably attaching said ears to said handle.

* * * * *